US007637075B2

(12) United States Patent
Mitchell

(10) Patent No.: US 7,637,075 B2
(45) Date of Patent: Dec. 29, 2009

(54) REINFORCED POLE STRUCTURE

(75) Inventor: James Mitchell, Mequon, WI (US)

(73) Assignee: Ruud Lighting, Inc., Racine, WI (US)

( * ) Notice: Subject to any disclaimer, the term of this patent is extended or adjusted under 35 U.S.C. 154(b) by 422 days.

(21) Appl. No.: 11/541,322

(22) Filed: Sep. 29, 2006

(65) Prior Publication Data

US 2008/0078141 A1 Apr. 3, 2008

(51) Int. Cl.
*E04C 3/00* (2006.01)

(52) U.S. Cl. ..... 52/834; 52/40; 52/170; 52/843

(58) Field of Classification Search ..... 52/834, 52/843, 169.13, 170, 28, 40; 254/134.3; 256/19, 65; 248/511, 903
See application file for complete search history.

(56) References Cited

U.S. PATENT DOCUMENTS

| | | | | |
|---|---|---|---|---|
| 1,939,530 | A | 12/1933 | Wall | |
| 3,865,498 | A | 2/1975 | Okuto et al. | |
| 3,947,191 | A | 3/1976 | Milner, Jr. | |
| 5,090,837 | A | 2/1992 | Mower | |
| 5,481,846 | A | 1/1996 | Macchietto | |
| 5,847,318 | A | 12/1998 | Chapman | |
| 5,878,540 | A | 3/1999 | Morstein | |
| 5,880,404 | A | 3/1999 | Stanley et al. | |
| 5,913,778 | A | 6/1999 | Hying et al. | |
| 6,058,575 | A | 5/2000 | Dugan | |
| 6,098,353 | A | 8/2000 | Stanfield | |
| 6,191,355 | B1 | 2/2001 | Edelstein | |
| 6,204,446 | B1 | 3/2001 | Parduhn | |
| 6,244,781 | B1 | 6/2001 | Roller | |
| 6,256,961 | B1 | 7/2001 | Byrnes | |
| 6,257,557 | B1 | 7/2001 | Anderson | |
| 6,287,042 | B1 | 9/2001 | Eriksson | |
| 6,405,991 | B1 | 6/2002 | Damiano | |
| 6,446,411 | B2 | 9/2002 | Natelli, Jr. | |
| 6,453,636 | B1 | 9/2002 | Ritz | |
| 6,519,909 | B1 * | 2/2003 | Fawley | 52/834 |
| 6,640,517 | B2 * | 11/2003 | Mitchell | 52/298 |
| 6,643,982 | B1 | 11/2003 | Lapp, Jr. et al. | |
| 6,645,596 | B1 | 11/2003 | Marakami et al. | |
| 6,685,154 | B1 | 2/2004 | Blyth et al. | |
| 6,742,314 | B2 | 6/2004 | Young | |
| 6,745,529 | B2 | 6/2004 | Beltran | |

(Continued)

FOREIGN PATENT DOCUMENTS

| | | |
|---|---|---|
| WO | WO2005/093161 | 10/2005 |

*Primary Examiner*—Richard E Chilcot, Jr.
*Assistant Examiner*—Patrick Maestri
(74) *Attorney, Agent, or Firm*—Jansson Shupe & Munger Ltd.

(57) ABSTRACT

A reinforced pole structure including a hollow pole with an interior surface and an access hand-hole therethrough near the bottom end and a base plate to which the bottom end of the pole is secured, the reinforced pole structure also including an elongate reinforcement device, preferably in the form of two elongate reinforcers, against the interior surface of the hollow pole, the lower edges of the reinforcers being welded to the pole at the bottom end and the hole-adjacent edge(s) of the reinforcers being welded to the lip of the hand-hole. Preferably, the reinforcers have a far-side pair of edges which, at least in positions opposite the hand-hole, are welded to the interior surface of the pole.

28 Claims, 5 Drawing Sheets

U.S. PATENT DOCUMENTS

| | | | |
|---|---|---|---|
| 6,820,389 | B1 | 11/2004 | Macchietto |
| 6,837,016 | B2 | 1/2005 | Simmons et al. |
| 6,851,247 | B1 | 2/2005 | Turner et al. |
| 6,890,461 | B2 | 5/2005 | Minayoshi et al. |
| 6,901,717 | B2 | 6/2005 | Brunozzi et al. |
| 6,938,392 | B2 | 9/2005 | Fouad et al. |
| 2004/0074199 | A1 | 4/2004 | Gordin et al. |
| 2006/0033336 | A1 | 2/2006 | Pulver |
| 2006/0150572 | A1 | 7/2006 | Rawson-Harris |

* cited by examiner

REINFORCED POLE STRUCTURE

FIELD OF THE INVENTION

The present invention relates to pole-mounting structures and systems and, in particular, to reinforced pole-and-base combinations for providing strength and endurance such as against wind forces and the like.

BACKGROUND OF THE INVENTION

A wide variety of pole-mounting systems and structures have been used to anchor poles and to provide support against wind loads and the like. These structures and systems have been used for light poles, flag poles, traffic signal supports, highway sign posts, telephone and electricity poles and a variety of other support poles.

Such poles are often very long and encounter great wind loads and other stresses. A common type of pole-mounting system utilizes a pole which is hollow, rectangular (e.g., square) in cross-section and includes a base support (or "plate") to which the lower end of the pole is welded or otherwise affixed. The base support may have bolt holes by which it is attached to bolts set in concrete, although other ground-attachment means may be used. Some pole-mounting systems use a variety of other structures for providing support for the poles. Various structures have been used in supporting each of the above-mentioned product types, and typically involve interconnection of a pole and a base support by welding and/or bolts.

Particular regions of concern when it comes to the strength and endurance of poles of various kinds include hand-hole areas—i.e., the areas typically near the pole bottoms used to facilitate wiring of fixtures—and any areas involving joints or juncture points or lines. Pole failures can be related to such things, making the nature of the structures of particular importance.

A particularly significant improvement in the strength of such poles is the invention disclosed in U.S. Pat. No. 6,640,517 (Mitchell), assigned to Ruud Lighting, Inc. of Racine, Wis. Such document is incorporated herein by reference. As noted in such patent, the Mitchell invention provides significant increases in pole strength and endurance. Increasing pole strength and endurance against wind forces and the like, and maintaining excellent pole strength and endurance (or even increasing them) while reducing material usage and consumer cost continue to be important industry objectives. Indeed, preferred forms of the invention described in this document are improvements of the prior Mitchell invention.

Despite improvements in the past, there remains a need for enhancement in pole strength, endurance and resistance to failure. And, there remains a need for these things to be achieved while minimizing material usage and cost and while retaining efficiency in manufacture and assembly.

OBJECTS OF THE INVENTION

With these things in mind, it is an object of this invention to provide an improved pole structure and pole-mounting system for reinforced strength and endurance against wind loads and the like.

Another object is to provide an improved reinforced pole structure and pole-mounting system that achieves greatly increased wind resistance without elaborate structural assembly requirements and without increased material usage.

Another object of the invention is to provide an improved reinforced pole structure substantially enhancing pole strength and endurance despite the inclusion of hand-holes in the lower portions of poles to facilitate wiring areas.

Another object of the invention is to provide an improved pole-mounting system and structure that may be efficiently manufactured.

Another object of the invention is to provide a reinforced pole structure providing enhanced strength and endurance while reducing material usage.

These and other objects of the invention will be apparent from the invention disclosure which follows.

SUMMARY OF THE INVENTION

This invention is an improvement in reinforced pole structures of the type including (a) a hollow pole formed by a wall with an interior surface and a lower portion that terminates in a bottom end and has an access hand-hole therethrough with a lip, and (b) a base plate to which the bottom end is secured. The improved reinforced pole structure includes an elongate reinforcement device against the interior surface of the hollow pole, such reinforcement device having lower, longitudinal and hole-adjacent edges, the lower edge(s) being welded to the pole at the bottom end and the hole-adjacent edge(s) being welded to the lip.

In particularly preferred embodiments, the reinforcement device includes two elongate reinforcers having the longitudinal edges, at least one of the reinforcers having the hole-adjacent edge(s), and at least portions of the longitudinal edges being welded to the interior surface. Each of such reinforcers preferably has a portion (or portions) of the hole-adjacent edge(s), and the reinforcers have (a) a near-pair of longitudinal edges that join the hole-adjacent edges and are adjacent to one side of the interior surface of the pole and (b) a far-pair of longitudinal edges that are adjacent to an opposite side of the interior surface of the pole and are welded thereto.

In particularly preferred embodiments, the far-pair of adjacent longitudinal edges have a gap therebetween of a width such that the far-pair of longitudinal edges are both welded to the interior surface by a single weld-line.

Most preferably, the portions of the hole-adjacent edges of the reinforcers are configured to be mirror images of each other. Indeed, the reinforcers as a whole are preferably structures that are mirror images of each other.

In certain of the preferred embodiments of this invention, the hollow pole has a substantially rectangular (most preferably square) cross-section and each of the reinforcers is of C-channel cross-section in mating engagement with the interior surface of the pole.

Preferably, the elongate reinforcers have an above-hole portion that is at least two inches in length and a longer below-hole portion. And, it is highly preferred the above-described far-pair of longitudinal edges of the elongate reinforcers be welded to the interior surface of the pole along a longitudinal distance that encompasses the length of the hand-hole and extends beyond the length of the hand-hole to some extent along each of the above-hole and below-hole portions of the reinforcers. Preferably, the length of the hand-hole is at least about five inches and the longitudinal distance is at least about two inches longer than that. The length of the below-hole portion of the reinforcers, including portions with far-side longitudinal edge welding to the interior surface of the pole and portions not welded to such interior surface, is preferably at least about twelve inches in length.

As already noted, it is preferred that there be welding of the far-side pair of longitudinal edges to the interior surface of the pole a positions immediately across from the hand-hole. Such hand-hole provides welding access to facilitate such welding, including to the extent going above and below the longitudinal edge portions immediately across from the hand-hole. In some cases, additional welding of the far-side pair of longitudinal edges to the interior surface of the pole is done at portions thereof near the bottom end of the pole, using the bottom opening for access for such welding. Some welding along the near-edge pair of longitudinal edges to the interior surface of the pole can be carried out in the same manner. All of this further enhances the strength of the reinforced pole structure.

In a particularly preferred form, this invention is an improvement in a pole-mounting system of the type including (a) a substantially horizontal base plate having a top and a bottom and an opening, (b) at least one upright ear attached to the base plate adjacent to the opening and terminating in an upper edge, and (c) a hollow pole as just mentioned, with, however, a lower portion received within the opening in the base and the ears on respective sides of the pole and secured to the exterior surface thereof by a welds along the upper edges of the ears. In such forms, the improvement of this invention includes the aforementioned elongate reinforcement device described above, and the preferred features and characteristics are applicable.

In such embodiments, it is most preferred that each ear be integrally formed with the base plate, that the entire upper edge of each ear be welded to the exterior surface of the pole, and that the bottom end of the pole be welded to the bottom of the base plate. The pole is preferably substantially rectangular (most preferably square) in cross-section, with each of the reinforcers being of C-channel cross-section in mating engagement with the interior surface of the pole.

DETAILED DESCRIPTION OF PREFERRED EMBODIMENTS

Figure 1:
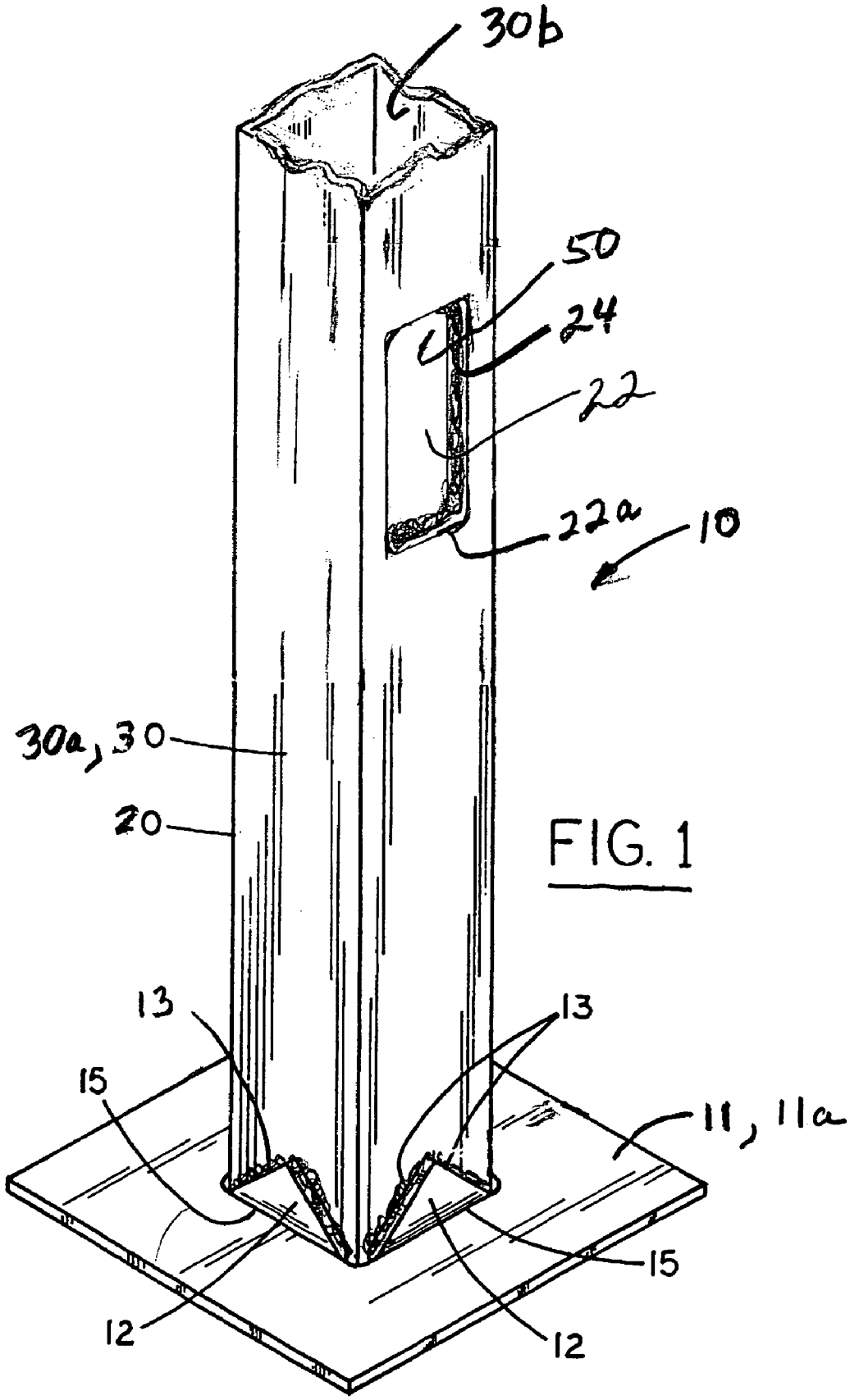
FIG. 1 is a fragmentary perspective view of a preferred reinforced pole structure in accordance with this invention.

The drawings show a reinforced pole structure 10 which is a particularly preferred embodiment of the invention. Pole structure 10 includes a substantially horizontal square base plate 11, a square hollow pole 20, and a reinforcement device in the form of a pair of mirror-image reinforcers 50. Such elements, which are preferably of steel, are welded together in the various ways described herein.

Base plate 11 has a top 11*a* and a bottom 11*b*, a square opening 11*c*, and four upright ears 12 attached to (indeed, integral with) the main portion of base plate 11. Four ears 12 are adjacent to opening 11*c* and terminate in upper edges, more about which will be described latter. (Such structure and its relationship to the hollow pole are prior art that is described in detail in the aforementioned Mitchell patent.) Ears 12 were formed by cutting or otherwise forming a pair of crossing slots in base plate 11 and then bending them upwardly, generally along bend lines/areas 15, so that each of ears 12 extends in a plane parallel to a respective one of the four sides of pole 20, as hereafter further described.

Figure 5:
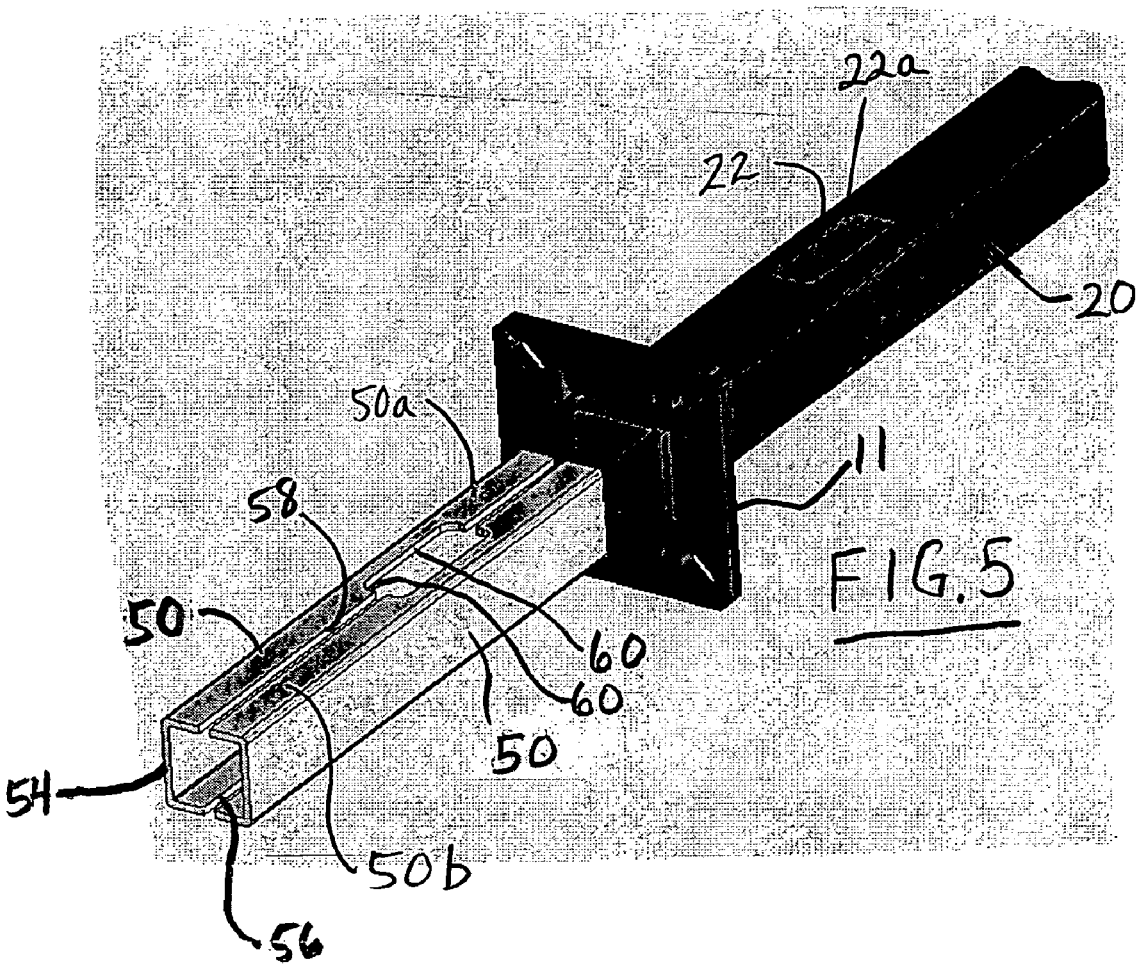
FIG. 5 is a reduced exploded perspective view showing the relationship of the reinforcers to remaining portions of the reinforced pole structure in a pre-assembly mode.
Figure 6:
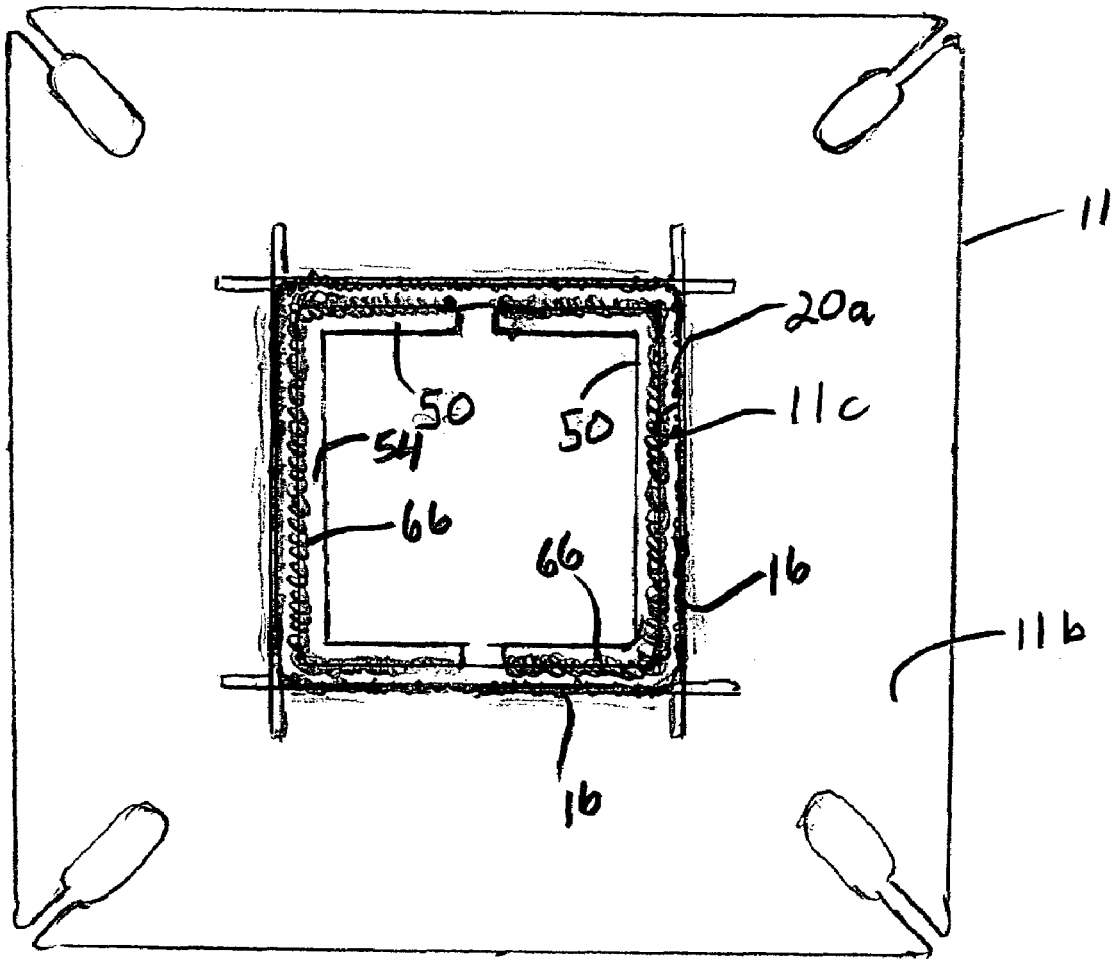
FIG. 6 is an enlarged bottom plan view, with no background shown inside the pole.

Hollow pole 20 has a wall 30 with exterior and interior surfaces 30*a* and 30*b*. Pole 20 includes a lower portion, which is all or substantially all of the pole portion illustrated in FIGS. 1, 2 and 5. The lower portion terminates in a bottom end 20*a* (see FIG. 6) that is received within opening 11*c* of base plate 11 and substantially flush with bottom 11*b* of base plate 11. Ears 12 extend up along and parallel to the four sides of the lower portion of pole 20 in positions immediately adjacent to exterior surfaces 30*a* of pole 20. As described in the Mitchell patent, the upper edges of ears 12 are welded by welds 13 (see FIGS. 1 and 2) to exterior surfaces 30*a* of pole 20. Also, as shown in FIG. 6, the edges of bottom end 20*a* of pole 20 are welded therealong by welds 16 to bottom 11*b* of base plate 11.

Wall 30 of hollow pole 20 forms, on one side of pole 20, a hand-hole 22 that has a lip 22*a* in a generally rectangular form with curved corners. Hand-hole 22 is used in various ways, as described herein, to facilitate the enhanced reinforcement of reinforced pole structure 10.

Mirror-image reinforcers 50, which constitute the reinforcement device, are each of C-channel cross-section and are configured for mating engagement with the form of interior surface 30*a* of pole 20. More specifically, not only are reinforcers 50 configured for insertion, together or separately, into opening 11*c* in base plate 11 and from there into the hollow interior of pole 20, but their cross-sectional configurations, which are mirror images of each other, are each complementary with the form of interior surface 30*a*—and mate therewith as reinforcers 50 are moved laterally away from one another within pole 20.

Each reinforcer 50 has a C-shaped upper edge 52, a C-shaped lower edge 54, an uninterrupted longitudinal edge 56 extending from upper edge 52 to lower edge 54, and an interrupted longitudinal edge 58 extending from upper edge 52 to lower edge 54 but with an interruption for hand-hole 22. More specifically, each reinforcer 50 has a top portion and a bottom portion of its interrupted longitudinal edge 58 that extend to a hole-adjacent edge 60 which is configured to match and extend along lip 22*a* of hand-hole 22—when reinforcers 50 are in their fully mated positions against interior surface 30*a* of pole 20.

Figure 2:
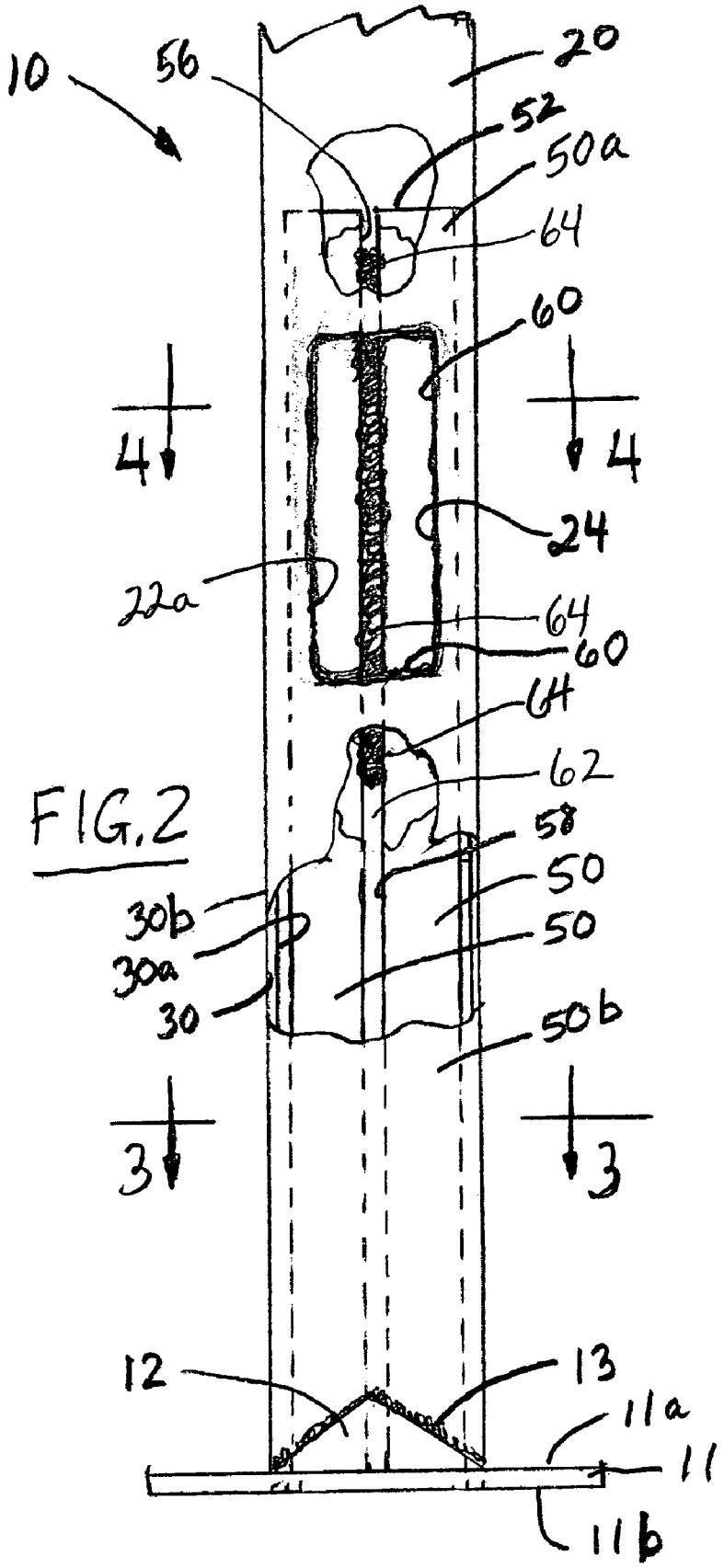
FIG. 2 is a fragmentary front elevation of the reinforced pole structure of FIG. 1 with certain portions broken away, and smaller portions of such broken-away portions double broken away, all to reveal underlying structures.
Figure 4:
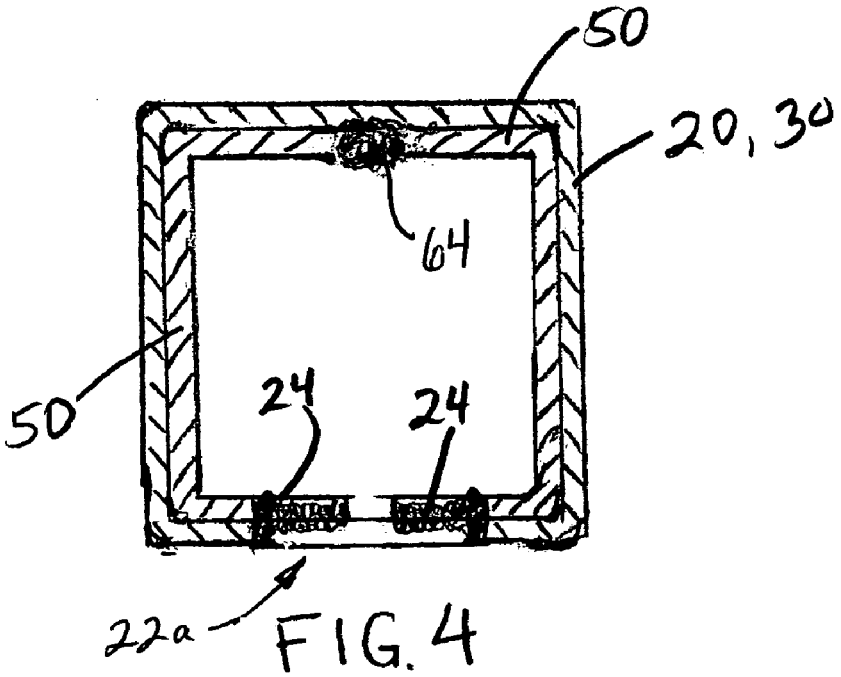
FIG. 4 is a sectional view taken along section 4-4 as indicated in FIG. 2, such sectional view excluding background beyond the bottom of the hand-hole.

As shown best in FIGS. 1 and 4, and to some extent in FIG. 2 as well, hole-adjacent edges 60 of both reinforcers 50 are welded to lip 22*a* along the full lengths and all portions of hole-adjacent edges 60 at weld-line 24, thereby providing significant enhancement of reinforcement at hand-hole 22. Given the position of weld-line 24, such welding operations are carried out easily.

Figure 3:
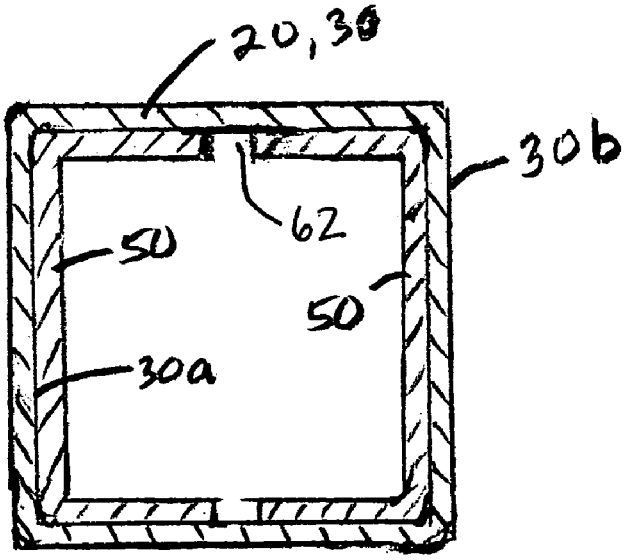
FIG. 3 is a sectional view taken along section 3-3 as indicated in FIG. 2, such sectional view excluding background.

Interrupted longitudinal edges 58 of reinforcers 50 form what is referred to herein as a near-pair of longitudinal edges that join hole-adjacent edges 60 and are adjacent to one side of interior surface 30*a* of pole 20. Uninterrupted longitudinal edges 56 of reinforcers 50 form what is referred to herein as a far-pair of longitudinal edges that are adjacent to an opposite side of interior surface 30*a* of pole 20. When reinforcers 50 are in their fully mated final positions, the far-side pair of uninterrupted longitudinal edges 56 have a gap 62 therebetween (see FIGS. 2 and 3) that is dimensioned such that both such edges 56 can be welded to interior surface 30*a* by a single weld-line 64 (see FIGS. 2 and 4). This facilitates welding operations.

The welding to form weld-line 64 is carried out by welding access through hand-hole 22, which is of sufficient size for this purpose. Weld-line 64 is made along the far-side pair of uninterrupted longitudinal edges 56 for the full portions thereof that are directly across from hand-hole 22, and for as much above and below such directly-across portions as reasonably possible using typical welding equipment and procedures.

As seen best in FIGS. 2 and 5, the preferred embodiment shown has elongate reinforcers 50 each with an above-hole portion 50*a* that is well in excess of two inches in length and a longer below-hole portion 50*b* that is about 12 inches in length. The vertical dimension of hand-hole 22, i.e., the dimension thereof along the length of pole 20, is of a size to facilitate insertion of a hand to get access to wires or connectors for wiring and connection purposes. More specifically, the length of the hand-hole along the pole is five or more inches. The width of hand-hole 22 is also chosen to facilitate hand insertion to an extent necessary to achieve necessary access.

FIG. 2 has break-away portions to show the total length of weld-line 64 in preferred reinforced pole structure 10. Above and below the location of hand-hole 22 are break-away portions to reveal parts of the near-pair of longitudinal edges of reinforcers 50—i.e., parts of interrupted longitudinal edges 58. And, each of such break-away portions has a further broken-away sub-portion that reveals the far-pair of uninterrupted longitudinal edges 56 that are welded to interior surface 30*a* of pole 20 by single weld-line 64. Weld-line 64 is continuous from the bottom thereof shown in the lower double broken-away portion of FIG. 2 to the top thereof shown in the upper double broken-away portion of FIG. 2. The upper and lower portions of weld-line 64 that are above and below the portion of weld-line 64 directly across from hand-hole 22 are each well in excess of one inch in length. Thus, the total length of weld-line 64 is more than two inches longer than the length of hand-hole 22.

In addition to the aforementioned welds along various edges of reinforcers 50, lower edges 54 of reinforcers 50 are welded therealong by weld-lines 66 to the immediately adjacent edges of bottom end 20*a* of pole 20.

The combination of welds involving reinforcers 50 of reinforced pole structure 10—i.e., weld-lines 66 (of lower edges 54 to bottom end 20*a* of pole 20), weld-line 64 (of uninterrupted longitudinal edges 56 to interior surface 30*a* of pole 20), and weld-lines 24 (of hole-adjacent edges 60 to lip 22*a* of hand-hole 22 of pole 20)—provides excellent enhancement of the structural strength and endurance of pole structure 10. And, it does so in a simple and inexpensive manner, with minimal additional parts and material. Indeed, it has been discovered, among other things, that excellent and enhanced strength and endurance can be made possible despite reductions in material, such as reductions in the thickness of pole stock used.

While the principles of the invention have been shown and described in connection with specific embodiments, it is to be understood that such embodiments are by way of example and are not limiting.

The invention claimed is:

1. In a reinforced pole structure of the type including (a) a hollow pole formed by a wall with an interior surface and a lower portion that terminates in a bottom end and has an access hand-hole therethrough with a lip, and (b) a base plate to which the bottom end is secured, the improvement comprising an elongate rigid reinforcement device against the interior surface, the reinforcement device having lower, longitudinal and hole-adjacent edges, the lower edge(s) being welded to the pole at the bottom end and the hole-adjacent edge(s) being welded to the lip.

2. The reinforced pole structure of claim 1 wherein the reinforcement device includes two elongate reinforcers having the longitudinal edges, at least one of the reinforcers having the hole-adjacent edge(s), and at least portions of the longitudinal edges being welded to the interior surface.

3. The reinforced pole structure of claim 2 wherein:

each of the reinforcers has portion(s) of the hole-adjacent edge(s); and the reinforcers have (a) a near-pair of longitudinal edges that join the hole-adjacent edges and are adjacent to one side of the interior surface of the pole and (b) a far-pair of longitudinal edges that are adjacent to an opposite side of the interior surface of the pole and are welded thereto.

4. The reinforced pole structure of claim 3 wherein the portions of the hole-adjacent edges of the two reinforcers are configured to be mirror images of each other.

5. The reinforced pole structure of claim 4 wherein the reinforcers are configured to be mirror images of each other.

6. The reinforced pole structure of claim 3 wherein the far-pair of adjacent longitudinal edges have a gap therebetween such that they are both welded to the interior surface by a single weld-line.

7. The reinforced pole structure of claim 6 wherein the portions of the hole-adjacent edges of the two reinforcers are configured to be mirror images of each other.

8. The reinforced pole structure of claim 7 wherein the reinforcers are configured to be mirror images of each other.

9. The reinforced pole structure of claim 3 wherein:

the pole has a substantially rectangular cross-section; and each of the reinforcers is of C-channel cross-section in mating engagement with the interior surface of the pole.

10. The reinforced pole structure of claim 9 wherein the far-pair of adjacent longitudinal edges have a gap therebetween such that they are both welded to the interior surface by a single weld-line.

11. The reinforced pole structure of claim 10 wherein the portions of the hole-adjacent edges of the two reinforcers are configured to be mirror images of each other.

12. The reinforced pole structure of claim 11 wherein the reinforcers are configured to be mirror images of each other.

13. The reinforced pole structure of claim 2 wherein the elongate reinforcers have an above-hole portion that is at least two inches in length and a longer below-hole portion.

14. The reinforced pole structure of claim 13 wherein the below-hole portion is at least about twelve inches in length.

15. The reinforced pole structure of claim 13 wherein:

each of the reinforcers has portion(s) of the hole-adjacent edge(s); and the reinforcers have (a) a near-pair of longitudinal edges that join the hole-adjacent edges and are adjacent to one side of the interior surface of the pole and (b) a far-pair of longitudinal edges that are adjacent to an opposite side of the interior surface of the pole and are welded thereto along a longitudinal distance encompassing the length of the hand-hole and extending beyond the length of the hand-hole to some extent along each of the above-hole and below-hole portions of the reinforcers.

16. The reinforced pole structure of claim 15 wherein the length of the hand-hole is at least about five inches and the longitudinal distance is at least about two inches longer.

17. In a pole-mounting system of the type including: (a) a substantially horizontal base plate having a top and a bottom and an opening; (b) at least one upright ear attached to the base plate adjacent to the opening and terminating in an upper edge; and (c) a hollow pole formed by a wall with interior and exterior surfaces and a lower portion that terminates in a bottom end and has an access hand-hole therethrough with a lip, the lower portion being received within the opening with each ear along a respective side of the pole being secured to the exterior surface by a weld along the upper edge of the ear, the improvement comprising: an elongate rigid reinforcement device against the interior surface, the reinforcement device having lower, longitudinal and hole-adjacent edges, the lower edge(s) being welded to the pole at the bottom end and the hole-adjacent edge(s) being welded to the lip.

18. The pole-mounting system of claim 17 the reinforcement device includes two elongate reinforcers having the longitudinal edges, at least one of the reinforcers having the hole-adjacent edge(s), and at least portions of the longitudinal edges being welded to the interior surface.

19. The pole-mounting system of claim 18 wherein:

each of the reinforcers has portion(s) of the hole-adjacent edge(s); and the reinforcers have (a) a near-pair of longitudinal edges that join the hole-adjacent edges and are adjacent to one side of the interior surface of the pole and (b) a far-pair of longitudinal edges that are adjacent to an opposite side of the interior surface of the pole and are welded thereto.

20. The pole-mounting system of claim 19 wherein the portions of the hole-adjacent edges of the two reinforcers are configured to be mirror images of each other.

21. The pole-mounting system of claim 20 wherein the reinforcers are configured to be mirror images of each other.

22. The pole-mounting system of claim 19 wherein the far-pair of adjacent longitudinal edges have a gap therebetween such that they are both welded to the interior surface by a single weld-line.

23. The pole-mounting system of claim 19 wherein:

each ear is integrally formed with the base plate;

the entire upper edge of each car is welded to the exterior surface of the pole; and the bottom end of the pole is welded to the bottom of the base plate.

24. The pole-mounting system of claim 23 wherein:

the pole has a substantially rectangular cross-section;

each of the reinforcers is of C-channel cross-section in mating engagement with the interior surface of the pole.

25. The pole-mounting system of claim 18 wherein the elongate reinforcers have an above-hole portion that is at least two inches in length and a longer below-hole portion.

26. The pole-mounting system of claim 25 wherein the below-hole portion is at least about twelve inches in length.

27. The pole-mounting system of claim 24 wherein:

each of the reinforcers has portion(s) of the hole-adjacent edge(s); and the reinforcers have (a) a near-pair of longitudinal edges that join the hole-adjacent edges and are adjacent to one side of the interior surface of the pole and (b) a far-pair of longitudinal edges that are adjacent to an opposite side of the interior surface of the pole and are welded thereto along a longitudinal distance encompassing the length of the hand-hole and extending into each of the above-hole and below-hole portions.

28. The pole-mounting system of claim 27 wherein the length of the hand-hole is at least about five inches and the longitudinal distance is at least about two inches longer.

* * * * *

UNITED STATES PATENT AND TRADEMARK OFFICE

CERTIFICATE OF CORRECTION

PATENT NO. : 7,637,075 B2
APPLICATION NO. : 11/541322
DATED : December 29, 2009
INVENTOR(S) : Mitchell It is certified that error appears in the above-identified patent and that said Letters Patent is hereby corrected as shown below:

In column 8, claim 23, line 7, delete "car" and insert --ear--.

Signed and Sealed this

Fifteenth Day of June, 2010

David J. Kappos

David J. Kappos
*Director of the United States Patent and Trademark Office*